US008511786B2

(12) United States Patent
Govyadinov et al.

(10) Patent No.: US 8,511,786 B2
(45) Date of Patent: Aug. 20, 2013

(54) LIGHT SCATTERING DROP DETECT DEVICE WITH VOLUME DETERMINATION AND METHOD

(75) Inventors: Alexander Govyadinov, Corvallis, OR (US); Kenneth Ward, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 970 days.

(21) Appl. No.: 12/581,712

(22) Filed: Oct. 19, 2009

(65) Prior Publication Data

US 2011/0090275 A1 Apr. 21, 2011

(51) Int. Cl.
*B41J 29/393* (2006.01)
*B41J 29/38* (2006.01)
*B41J 2/07* (2006.01)

(52) U.S. Cl.
USPC ..... 347/19; 347/14; 347/74

(58) Field of Classification Search
USPC ..... 347/9, 12–14, 19, 40, 74
See application file for complete search history.

(56) References Cited

U.S. PATENT DOCUMENTS

| | | | |
|---|---|---|---|
| 4,422,719 | A | 12/1983 | Orcutt |
| 5,304,814 | A | 4/1994 | Markham |
| 5,428,218 | A | 6/1995 | Toughlian et al. |
| 5,589,858 | A | 12/1996 | Kadowaki et al. |
| 5,621,524 | A | 4/1997 | Mitani |
| 5,742,303 | A | 4/1998 | Taylor et al. |
| 5,774,141 | A | 6/1998 | Cooper et al. |
| 5,856,833 | A | 1/1999 | Elgee et al. |
| 5,896,145 | A | 4/1999 | Osborne et al. |
| 6,088,134 | A | 7/2000 | Schmidt |
| 6,168,258 | B1 | 1/2001 | Lou et al. |
| 6,299,275 | B1 | 10/2001 | Elgee |
| 6,513,900 | B2 | 2/2003 | Endo et al. |
| 6,517,184 | B1 | 2/2003 | Bruch et al. |
| 6,525,863 | B1 | 2/2003 | Riza |
| 6,565,179 | B1 | 5/2003 | Bruch et al. |
| 6,585,349 | B1 | 7/2003 | Lou et al. |
| 6,648,444 | B2 | 11/2003 | Valero et al. |
| 6,747,684 | B2 | 6/2004 | Ornellas et al. |

(Continued)

FOREIGN PATENT DOCUMENTS

| | | |
|---|---|---|
| JP | 2001113725 | 4/2001 |
| JP | 2005083769 | 3/2005 |

(Continued)

OTHER PUBLICATIONS

Svanholm, Erik, "Printability and Ink-Coating Interactions in Inkjet Printing," Dissertation, Karlstad University Studies 2007:2, pp. 58 (Feb. 2007).

(Continued)

*Primary Examiner* — Charlie Peng
*Assistant Examiner* — Hung Lam

(57) ABSTRACT

One aspect is a drop detection arrangement including a light source for projecting a light beam for scattering light off of an ejected drop. The arrangement includes a light collector configured to collect the scattered light off the ejected drop and configured to process scattered light into an output signal. The arrangement includes a controller configured to receive the output signal from the light collector, to calculate the velocity of the ejected drop and to determine the volume of the ejected drop using the output signal and the velocity of the ejected drop.

14 Claims, 5 Drawing Sheets

(56) References Cited

U.S. PATENT DOCUMENTS

| | | | | |
|---|---|---|---|---|
| 6,767,122 | B2 | 7/2004 | Honguh et al. | |
| 6,769,756 | B2 | 8/2004 | Su et al. | |
| 6,786,626 | B2 | 9/2004 | Wu et al. | |
| 6,802,580 | B2 | 10/2004 | Valero | |
| 6,814,422 | B2 | 11/2004 | Bruch et al. | |
| 6,851,816 | B2 | 2/2005 | Wu et al. | |
| 6,877,838 | B2 | 4/2005 | Elgee | |
| 6,935,717 | B2 | 8/2005 | Su et al. | |
| 6,966,664 | B2 | 11/2005 | Wu | |
| 6,969,159 | B2 | 11/2005 | Su et al. | |
| 6,984,013 | B2 | 1/2006 | Arqullevich et al. | |
| 7,055,925 | B2 | 6/2006 | Subirada et al. | |
| 7,125,151 | B2 | 10/2006 | Uemura et al. | |
| 7,140,762 | B2 | 11/2006 | Wu et al. | |
| 7,249,830 | B2 | 7/2007 | Hawkins et al. | |
| 7,267,467 | B2 | 9/2007 | Wu et al. | |
| 7,287,824 | B2 | 10/2007 | Subirada et al. | |
| 7,287,833 | B2 | 10/2007 | Howard | |
| 7,364,276 | B2 | 4/2008 | Piatt et al. | |
| 7,434,919 | B2 | 10/2008 | Hawkins et al. | |
| 7,442,180 | B2 | 10/2008 | Vitello et al. | |
| 7,452,053 | B2 | 11/2008 | Valles et al. | |
| 7,490,918 | B2 | 2/2009 | Nagashima | |
| 7,513,616 | B2 | 4/2009 | Lin | |
| 7,832,822 | B2 | 11/2010 | Kiyama et al. | |
| 2001/0019480 | A1 | 9/2001 | Fujino et al. | |
| 2003/0193608 | A1 | 10/2003 | Yen | |
| 2003/0218648 | A1 | 11/2003 | Barnes et al. | |
| 2004/0254527 | A1* | 12/2004 | Vitello et al. | 604/82 |
| 2005/0021244 | A1 | 1/2005 | Nicoli et al. | |
| 2005/0024410 | A1 | 2/2005 | Subirada et al. | |
| 2005/0253890 | A1 | 11/2005 | Nagashima | |
| 2006/0103691 | A1 | 5/2006 | Dietl et al. | |
| 2006/0120098 | A1 | 6/2006 | Ikeda et al. | |
| 2006/0139392 | A1 | 6/2006 | Fernandez et al. | |
| 2006/0187651 | A1 | 8/2006 | Kim et al. | |
| 2006/0279601 | A1 | 12/2006 | Unosawa et al. | |
| 2007/0024658 | A1 | 2/2007 | Diol et al. | |
| 2007/0030300 | A1 | 2/2007 | Jeong | |
| 2007/0064068 | A1 | 3/2007 | Piatt et al. | |
| 2008/0180471 | A1 | 7/2008 | Han | |
| 2008/0246803 | A1 | 10/2008 | Barger et al. | |
| 2009/0027459 | A1* | 1/2009 | Hawkins et al. | 347/74 |
| 2009/0091595 | A1 | 4/2009 | Hayashi et al. | |
| 2009/0141057 | A1 | 6/2009 | Hayashi et al. | |
| 2009/0179934 | A1 | 7/2009 | Takagi et al. | |
| 2009/0244141 | A1 | 10/2009 | Govyadinov et al. | |
| 2009/0244163 | A1 | 10/2009 | Govyadinov | |
| 2009/0273620 | A1* | 11/2009 | Govyadinov et al. | 347/9 |
| 2009/0310206 | A1 | 12/2009 | Gluckstad | |
| 2010/0207989 | A1 | 8/2010 | Govyadinov | |
| 2012/0013906 | A1 | 1/2012 | Govyadinov et al. | |

FOREIGN PATENT DOCUMENTS

| | | | |
|---|---|---|---|
| JP | 2006047235 | | 2/2006 |
| JP | 2006346906 | | 12/2006 |
| JP | 2007111971 | | 5/2007 |
| WO | 2007015808 | A1 | 2/2007 |
| WO | 2009120436 | A1 | 10/2009 |

OTHER PUBLICATIONS

The Written Opinion of the International Searching Authority for International Application No. PCT/US2009/034892 mailed Jul. 28, 2009 (5 pages).

The International Search Report for International Application No. PCT/US2009/034892 mailed Jul. 28, 2009 (3 pages).

The Restriction Requirement for U.S. Appl. No. 12/381,873 mailed on Sep. 29, 2010 (6 pages).

The Restriction Requirement for U.S. Appl. No. 12/079,338 mailed on Mar. 17, 2011 (7 pages).

The Restriction Requirement for U.S. Appl. No. 12/388,805 mailed on Jul. 14, 2011 (6 pages).

The Office Action for U.S. Appl. No. 12/254,864 mailed on Jun. 11, 2010 (23 pages).

The Office Action for U.S. Appl. No. 12/381,873 mailed on Feb. 4, 2011 (12 pages).

The Office Action for U.S. Appl. No. 12/079,338 mailed on Jul. 25, 2011 (15 pages).

The Office Action for U.S. Appl. No. 12/388,805 mailed on Aug. 25, 2011 (19 pages).

The Office Action for U.S. Appl. No. 12/381,873 mailed on Sep. 1, 2011 (11 pages).

The Notice of Allowance for U.S. Appl. No. 12/254,864 mailed on Dec. 1, 2010 (12 pages).

McLeod, Euan et al., "Complex Beam Sculpting with Tunable Acoustic Gradient Index Lenses," SPIE, Complex Light and Optical Forces, vol. 6483, pp. 1-9, (2007).

The Office Action for U.S. Appl. No. 12/079,338 mailed May 25, 2012 (6 pages).

The Office Action for U.S. Appl. No. 12/079,338 mailed Dec. 12, 2012 (7 pages).

The Final Office Action for U.S. Appl. No. 12/079,338 mailed Feb. 8, 2012 (7 pages).

The Advisory Action for U.S. Appl. No. 12/079,338 mailed Apr. 18, 2012 (3 pages).

The Final Office Action for U.S. Appl. No. 12/388,805 mailed Jan. 13, 2012 (14 pages).

The Advisory Action for U.S. Appl. No. 12/388,805 mailed Mar. 19, 2012 (3 pages).

The Office Action for U.S. Appl. No. 12/388,805 mailed Oct. 17, 2012 (10 pages).

The Notice of Allowance for U.S. Appl. No. 12/381,873 mailed Feb. 8, 2012 (15 pages).

The Notice of Allowance for U.S. Appl. No. 12/837,098 mailed Sep. 10, 2012 (8 pages).

The Office Action for U.S. Appl. No. 12/837,098 mailed Apr. 26, 2012 (20 pages).

* cited by examiner

LIGHT SCATTERING DROP DETECT DEVICE WITH VOLUME DETERMINATION AND METHOD

BACKGROUND

In some applications, drop detection devices are utilized to detect liquid drops ejected by ejector nozzles. Based on the detection of liquid drops, the status of a particular nozzle or groups of nozzles can be diagnosed. In some cases light scattering from the ejected drops is used in the drop detection devices.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
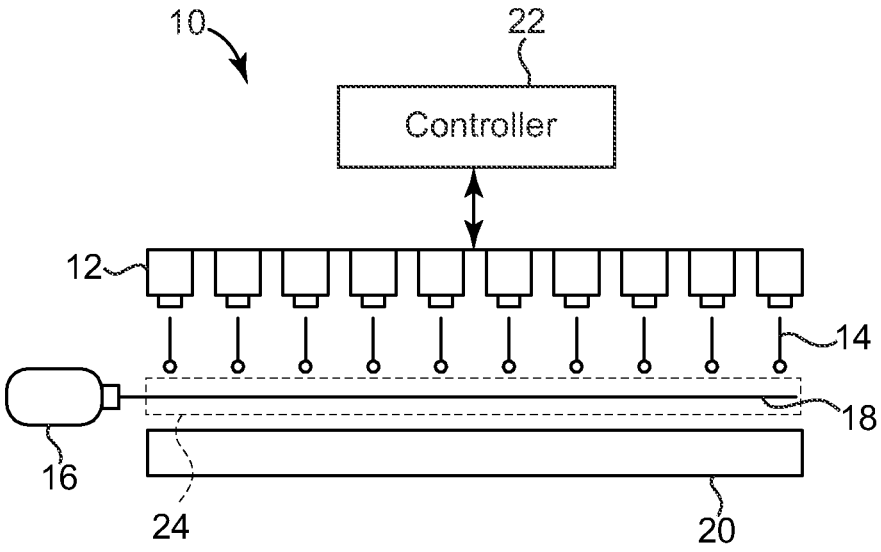
FIG. 1 is a drop detector arrangement in accordance with one embodiment.

FIG. 1 illustrates a drop detector arrangement 10 in accordance with one embodiment. In one embodiment, drop detector arrangement 10 includes a plurality of drop ejectors 12, each configured to dispense a liquid droplet 14. Arrangement 10 further includes a light source 16, which emits a light beam 18. Arrangement 10 also includes service station 20, controller 22, and light collector 24. In operation of one embodiment, drop detector arrangement 10 is configured for use in a variety of applications where the controlled ejection of liquid droplets is to be monitored.

For example, in one application ink drops are deposited on print media in a print engine for an inkjet printer. In such an application, drop detector arrangement 10 may be used to monitor the ejection of ink. In other applications, drop detector arrangement 10 may be used to monitor the ejection of liquid in biochemical tests, diagnostic strips or device coating applications.

In one embodiment, controller 22 is configured to control the plurality of drop ejectors 12 such that liquid droplets 14 are controllably ejected to service station 20. In one embodiment, print media is received adjacent service station 20 such that liquid droplets 14 are controllably deposited on the print media.

In one embodiment, light source 16 is configured to project light beam 18 between the plurality of drop ejectors 12 and service station 20. As such, when liquid droplets 14 are ejected drop ejectors 12, liquid droplets 14 pass through light beam 18 as they drop to service station 20. In various embodiments, light source 16 may be a collimated source, such as a laser source, or an LED.

As a liquid droplet 14 passes through light beam 18, light from light beam 18 is scattered in various directions. Light collector 24 is illustrated adjacent light beam 18 and some of the scattered light will enter light collector 24. Light collector 24 is illustrated in dotted lines in FIG. 1, because it is "behind" light beam 18 in the particular orientation in the figure.

In one embodiment, light collected into light collector 24 from the light scattering that occurred when liquid droplet 14 passed through light beam 18 can be used to measure the effectiveness or status of liquid droplet 14 from one or more of ejectors 12. For example, if controller 22 directs one particular drop ejector to eject a liquid droplet 14 at a particular point in time, corresponding light scattering from liquid droplet 14 passing through light beam 18 should enter light collector 24. By monitoring the collected light and correlating it with control signals from controller 22, a determination can be made as to whether a liquid droplet 14 did in fact eject, as well as determinations about the size, velocity and quality of liquid droplet 14.

In one embodiment, light collector 24 includes a light detector. In one embodiment, a first end of light collector 24 is located adjacent light source 16 and the light detector is located at a second end of light collector 24, which is opposite the first end. In one example, the light detector is coupled to controller 22, which is configured to process light signals that are collected in light collector 24 and then coupled into the light detector. In one example, a separate controller from controller 22 may be used to process the collected light signals.

Figure 2A:
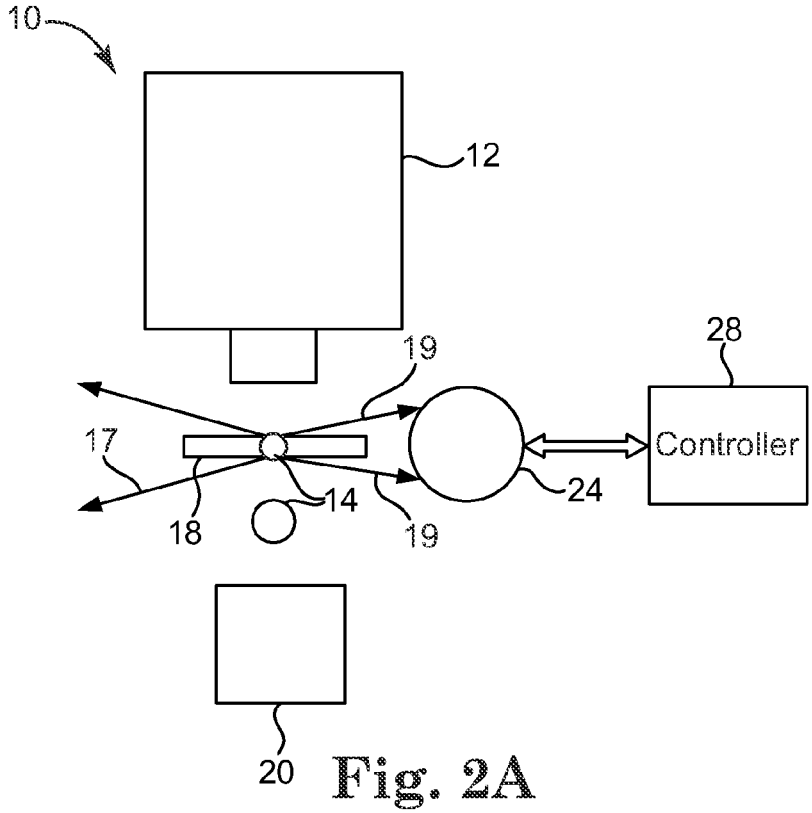
FIG. 2A illustrates a cross-sectional view of a drop detector arrangement in accordance with one embodiment.

FIG. 2A illustrates a cross-sectional view of drop detector arrangement 10 in accordance with one embodiment. In FIG. 2A, a drop ejector 12 is illustrated above service station 20. A light beam 18 is illustrated between drop ejector 12 and service station 20 and liquid droplets 14 are illustrated passing through light beam 18. Light collector 24 is illustrated adjacent light beam 18 and positioned vertically in the figure between drop ejector 12 and service station 20.

In one embodiment, light source 16 is a collimated light source such as a laser source or similar device. In various embodiments, the shape of light beam 18 is circular, elliptical, rectangular (as illustrated in FIG. 2A) or other shape. As liquid droplets 14 pass through light beam 18, light is scattered in various directions (17, 19).

As illustrated in the embodiment, as a liquid droplet 14 passes through light beam 18, scattered light 17 and 19 is deflected in various orientations. Light will scatter in many directions, but for ease of illustration just a few examples are shown. Some scattered light 17 is directed away from light collector 24, while some scattered light 19 is directed into light collector 24. In one embodiment, light collector 24 is configured to collect scattered light 19 and to direct it to the light detector and controller 28 for further processing.

In one embodiment, light collector 24 is a tubular-shaped light pipe that is configured to be adjacent each of a series of drop ejector nozzles 12. As such, as each nozzle 12 ejects a liquid droplet 14 through light beam 18, scattered light 19 is collected all along the length of light collector 24. In this way, only a single collector 24 is needed to collect scattered light 19 from a plurality of drop ejectors 12 located along its length. Collector 24 then propagates all of this collected scattered light 19 from the various liquid droplets 14 to the light detector and controller 28 for further processing.

In one embodiment, light collector 24 is configured with grating or a pitch that is angled to deflect most of scattered light 19 toward a light detector coupled to controller 28. In one embodiment, the light detector includes a photodetector, or similar sensor of light or other electromagnetic energy capable of detecting scattered light 19 from droplet 14 passing through light beam 18. In one embodiment, the light detector includes a charge-coupled device (CCD) or CMOS array having a plurality of cells that provide sensing functions. The CCD or CMOS array by means of the plurality of cells detects the light in its various intensities. In one embodiment, the light detector receives scattered light 19 and generates an electrical signal that is representative of the scattered light 19 for processing by controller 28.

Figure 2B:
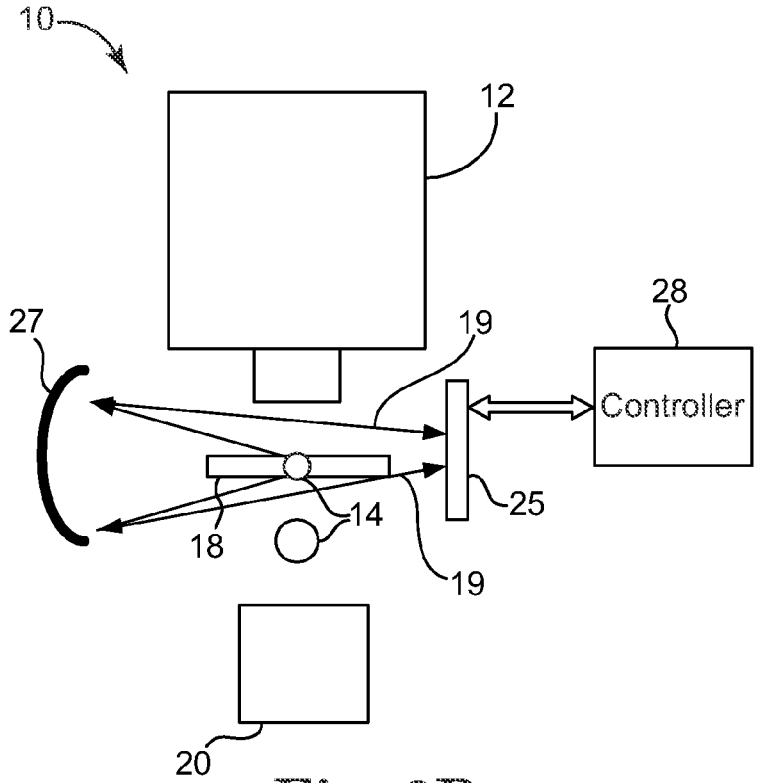
FIG. 2B illustrates a cross-sectional view of a drop detector arrangement in accordance with another embodiment.

FIG. 2B illustrates a cross-sectional view of drop detector arrangement 10 in accordance with one alternative embodiment. FIG. 2B is similar to FIG. 2A such that a drop ejector 12 is illustrated above service station 20, a light beam 18 is illustrated between drop ejector 12 and service station 20 and liquid droplets 14 are illustrated passing through light beam 18. As an alternative to light collector 24 in FIG. 2A, FIG. 2B illustrated light collector 25 and light deflection device 27. The light deflection device 27 can be a lens, a mirror or the like capable of directing the light scattered off of droplet 14 to light collector 25, which includes a light detector that receives scattered light 19 and generates an electrical signal that is representative of the scattered light 19 for processing by controller 28.

In an embodiment, light collector 25 may be a photodetector or may be a photodetector array such as CCD, CMOS or even Avalanche Photo Detectors (APD). Typically the CCD array may have a plurality of cells that provide the sensing functions. The CCD array, by means of the plurality of cells, detects the light in its various intensities. Each liquid droplet 14 is identified from the detected light intensity of a group of one or more cells of the CCD array.

Similar to light collector 24 in FIG. 2A, based on the various light intensities collected at light collector 25, droplet characteristics, such as the presence and/or absence of drops, the size of the drops, and the falling angle of the drops are determined. Accordingly, the controller 28 associated with light collector 25 may determine the status of the drop ejectors 12 based on the characteristics of the liquid droplets 14, or may determine the characteristics of droplets 14 themselves.

Figure 3:
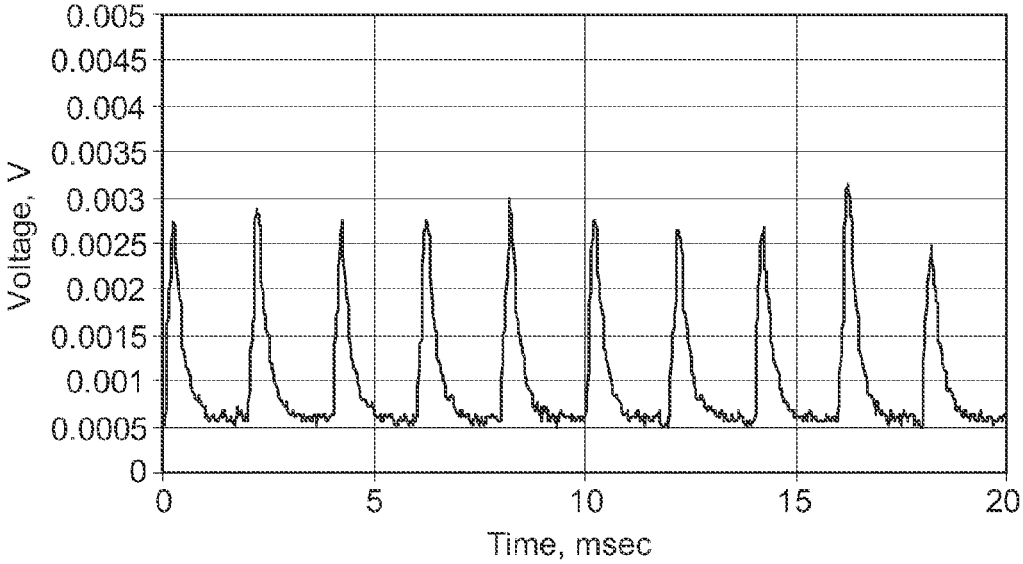
FIG. 3 illustrates a signal representative of light collected in a light collector in a drop detector arrangement in accordance with one embodiment.

As evident from FIGS. 2A and 2B, there are alternative mechanisms for a drop detector arrangement to collect scattered light and process it for analysis in accordance with embodiments. FIG. 3, illustrates an output signal representative of scattered light 19 collected in a drop detector arrangement 10. In the illustrated example, a drop detection of nozzle firing with 500 Hz frequency is shown. Every peak corresponds to individual droplets 14, ejected from drop ejector-nozzle 12. In the illustration, the signal has a plurality of voltage peaks over time, that is, just before 1 millisecond, just after 2 milliseconds at approximately 4 milliseconds, and so on. Each of these peaks represents a peak amount of scattered light 19 collected and processed by controller 28 due to a liquid droplet 14 having passed through light beam 18.

In one embodiment, controller 22 controls the plurality of drop ejectors 12 such that each is configured to dispense a liquid droplet 14 at a specified time.

As such, each corresponding liquid droplet 14 passes though light beam 18 at a known time, and the corresponding collected scattered light 19 produces a peak in the output signal that can be correlated by controller 28 in order to verify a liquid droplet 14 was indeed produced, and also to determine the volume of each liquid droplet 14 produced.

Figure 4:
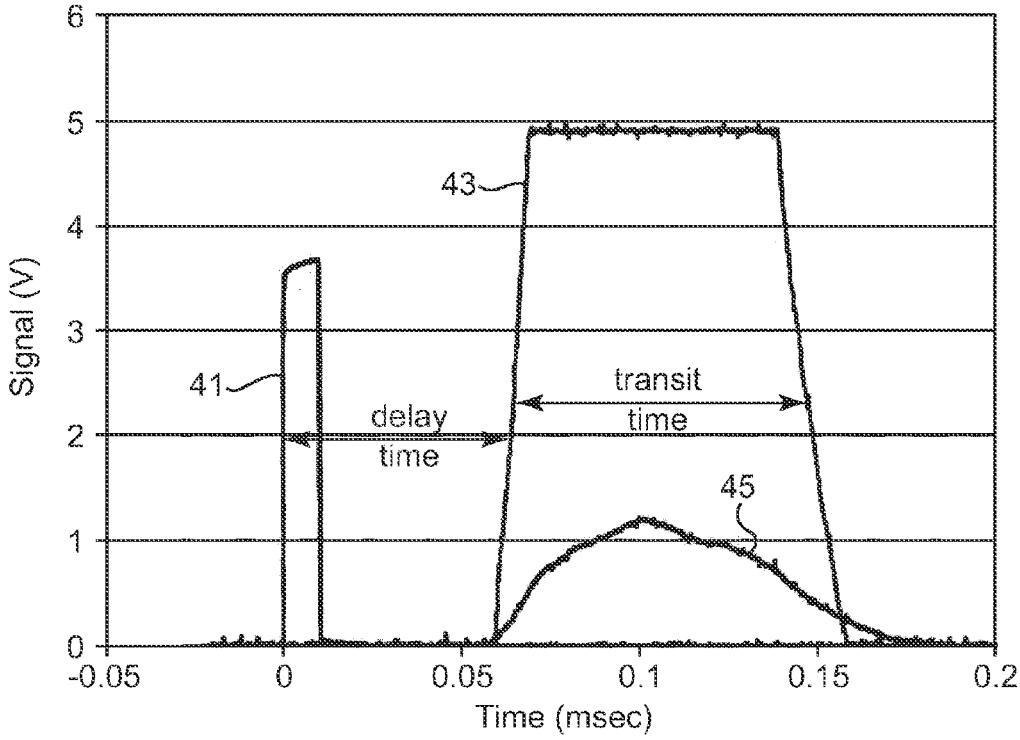
FIG. 4 illustrates a control signal temporally spaced relative to a signal representative of light collected in a light collector in a drop detector arrangement in accordance with one embodiment.

FIG. 4 illustrates signals for a controller synchronization pulse 41 and a corresponding raw light detector signal 45. As illustrated, after controller 22 controls ejector 12 to release liquid droplet 14 with sync pulse 41, after a time delay, scattered light 19 is detected and processed as detector signal 45. For the amount of time that liquid droplet 14 passes through light beam 18—the transit time—raw light detector signal 45 is produced. In the illustration, raw light detector signal 45 is amplified as amplified light detector signal 43.

The light detector signal 45 is related to drop volume. A relationship of the scattered light signal to other elements in drop detector arrangement 10 may be defined as follows:

$$I_{LS} \sim I \cdot V \cdot k / v_0,$$

or $$I_{LS} \sim V \cdot \Delta t,$$

where:

$I_{LS}$=intensity of light scattering (LS),
I=laser beam intensity,
V=drop volume,
k=drop form factor,
$v_0$=drop velocity, and
$\Delta t$=drop exposure time in laser beam.

Based on these relationships, a drop volume relationship may be derived by either of the two following:

$$V \sim I_{LS}^{max} / v_0, \quad \{\text{relationship 1}\}$$

where:

V=drop volume,
$I_{LS}^{max}$=maximum (peak) of Intensity of light scattering (LS) $I_{LS}(t)$, and
$v_0$=drop velocity.

or $$V \sim [\int I_{LS} dt] / v_0, \quad \{\text{relationship 2}\}$$

where:

$\int I_{LS} dt$=light scattering $I_{LS}$ peak area.

Figure 5A:
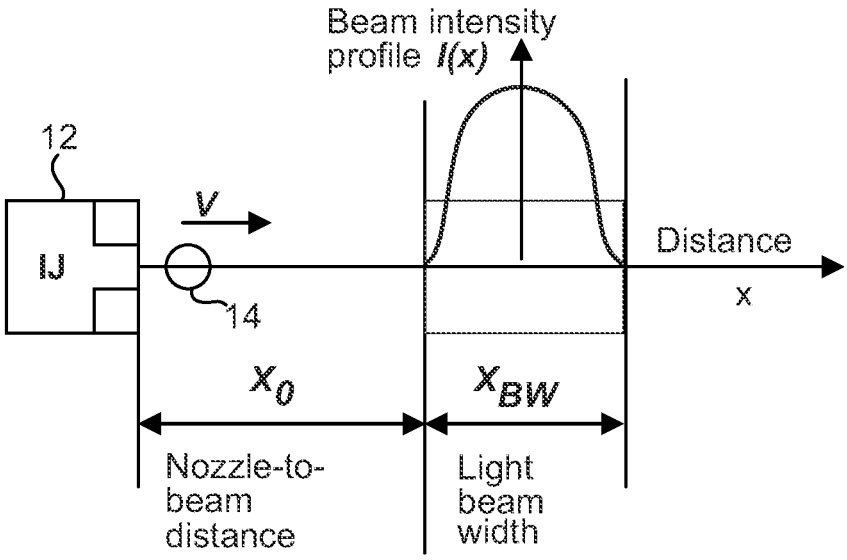
FIG. 5A illustrates a special diagram of a light beam intensity profile in accordance with one embodiment.
Figure 5B:
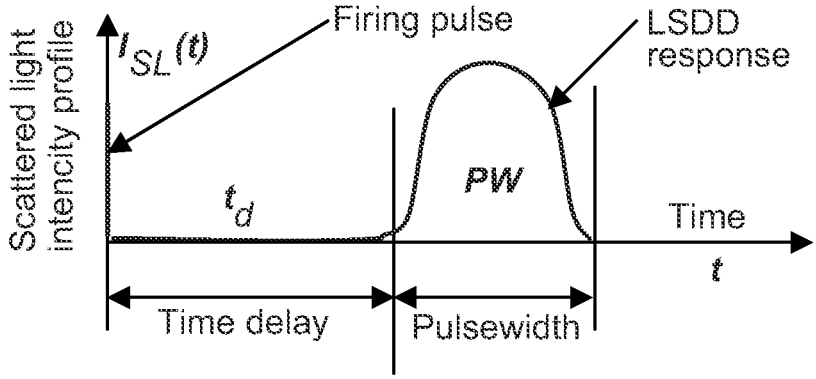
FIG. 5B illustrates a temporal diagram of a light beam intensity profile in accordance with one embodiment.

These relationships are useful for evaluation of drop size for a geometry of drop detector arrangement 10. FIGS. 5A and 5B respectively illustrate the distance and time relationships given above for drop detector arrangement 10. In FIG. 5A, a droplet 14 is illustrated moving away from ejector 12 at a velocity (v). The droplet 14 will travel a distance $x_0$ from ejector 12 until it reaches light beam 18. Once droplet 14 reaches light beam 18 it will travel through the width of the light beam, which is illustrated as distance $x_{BW}$. The beam intensity profile I(x) of light scattering (LS) is reflected over that distance as droplet 14 passes through the width of the light beam $x_{BW}$.

In FIG. 5B, a corresponding time relationship to the distance relationship in FIG. 5A is illustrated. The firing pulse for releasing a droplet 14 from ejector 12 is illustrated at the start, and a time delay $t_d$ is illustrated from that point until the droplet 14 reaches light beam 18. Once the droplet 14 reaches light beam 18, the time it takes to travel though it is illustrated as the pulse width (PW).

Drop velocity $v_0$ may be derived from the waveforms illustrated in FIG. 5B. For example, a droplet 14 with volume V leaves nozzle ejector 12 with velocity $v_0$. After time delay $t_d=x_0/v_0$ the droplet 14 reaches light beam 18 and scatters light, generating pulse $I_{LS}(t)$.

Because controller 22 is configured to control the ejection of each droplet 14 from ejectors 12 and light collector 24 is configured to collect light as the droplet 14 reaches light beam 18, the delay time $t_d$ is calculable within controller 22. The nozzle-to-beam distance $x_0$ is known in any given drop detector arrangement 10 such that velocity $v_0$ is calculated using nozzle-to-beam distance $x_0$ and delay time ($t_d$).

Volume (V) of the droplet 14 may then be determined using this velocity $v_0$ calculation along with relationship 1 or 2 given above. In relationship 1, the maximum (peak) of intensity of light scattering $I_{LS}^{max}$ is measured from the scattered light 19 collected at light collector 24, then it is divided by the calculated velocity $v_0$ of the droplet 14. In relationship 2, the intensity of light scattering $I_{LS}$ is integrated over the time period of the pulse width (PW), then it is divided by the calculated velocity $v_0$ of the droplet 14. In either case, a representation of the droplet volume (V) is made.

Figure 6A:
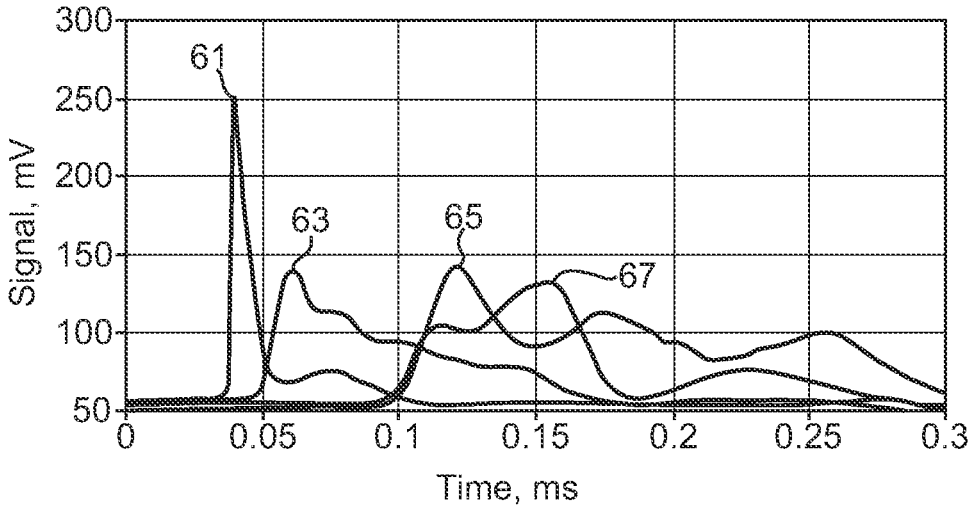
FIG. 6A illustrates signals representative of light collected in a light collector in a drop detector arrangement in accordance with one embodiment.

FIG. 6A illustrates four output signals representative of scattered light 19 collected in a drop detector arrangement 10, each corresponding to different liquids ejected from ejector 12. In the illustration, signal 61 illustrates an output signal from light collected from water ($H_2O$) droplets 14 ejected from ejectors 12; signal 63 illustrates an output signal from light collected from a seventy percent dimethyl sulfoxide/thirty percent $H_2O$ solution (70% DMSO) droplets 14 ejected from ejectors 12; signal 65 illustrates an output signal from light collected from isopropyl alcohol (IPA) droplets 14 ejected from ejectors 12; and signal 67 illustrates an output signal from light collected from a one hundred percent dimethyl sulfoxide solution (100% DMSO) droplets 14 ejected from ejectors 12.

In one embodiment, the same geometry is used within drop detector arrangement 10 for generating each of output signals 61, 63, 65 and 67. For example, the same firing energy is used, the same detector, same lens, same distance, same angles, same light source optical power, same power density, same wavelength and so forth. As such, once the area under each output signal is calculated, variations in the calculated area is proportional to the droplet volume as indicate in relationships 1 and 2 above. Once drop velocity is calculated, each area calculation may be divided by the velocity such that drop volume is indicated.

Figure 6B:
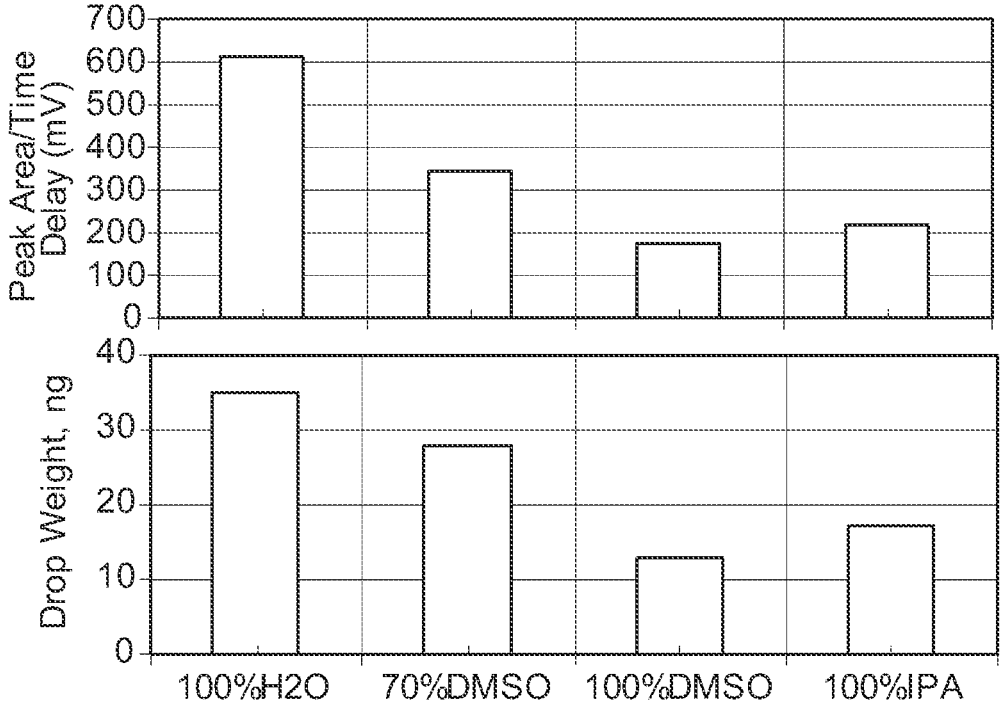
FIG. 6B illustrates representations of drop volume of ejected drops in a drop detection arrangement in accordance with one embodiment.

FIG. 6B (in the upper bar graph) illustrates this calculation of peak area for each of the output signals 61, 63, 65 and 67 divided by the time delay for the corresponding droplet. For purposes of comparison, the lower bar graph in FIG. 6B illustrates an independent gravimetric measurement of the drop weight for 100% water, 70% DMSO with 30% water, 100% DMSO and 100% Isopropyl Alcohol (IPA). As such, these two bar graphs show good correlation of the LSDD based drop volume evaluation and measured gravimetrically drop weight for the same ejector 12. As such, by calibrating these calculations from the output signals in drop detector arrangement 10 (such as the upper bar graph of FIG. 6B), to known drop size or weight (such as the lower bar graph of FIG. 6B), a representation of drop volume is determined from the output signal collected in drop detector arrangement 10.

Although the calculated signal area/time delay in the upper bar graph of FIG. 6B is not directly a drop volume or drop weight, this signal is representative of it. This signal area/time delay signal can also be converted into drop weight by determining the light scattering efficiency or light scattering cross-section.

In either case, whether by conversion or calibration, the output signal representative of scattered light 19 collected in a drop detector arrangement 10, such as that illustrated in FIG. 3, provides an indication for each droplet 14. For example, in FIG. 3, each peak corresponds to individual droplets 14. By calculating the area under each peak in the output signal, and then dividing by the calculated velocity of the droplet, the droplet volume for each droplet is determined. In certain applications it may be useful to have the actual droplet volume of each individual droplet in this way, rather than having to use an estimation of droplet volume based on an average obtained over time from multiple droplets.

For example, in precision dispensing in the range of picoliters or microliters, it may be useful to know the volume of each individual droplet, including any variations from droplet to droplet. In some biochemical testing, diagnostic strips, device coatings and other printed materials, such individual droplet volume determinations may be useful.

A drop detection arrangement as disclosed herein allows a calculation of the velocity of an ejected drop, and a determination of the volume of the ejected drop using the output signal and the velocity of the ejected drop.

Although specific embodiments have been illustrated and described herein, it will be appreciated by those of ordinary skill in the art that a variety of alternate and/or equivalent implementations may be substituted for the specific embodiments shown and described without departing from the scope of the present invention. For example, the drop detector arrangement 10 could be used in conjunction with a computer printer, or with any of a variety of drop ejection systems while remaining within the spirit and scope of the present invention. This application is intended to cover any adaptations or variations of the specific embodiments discussed herein. Therefore, it is intended that this invention be limited only by the claims and the equivalents thereof.

What is claimed is:

1. A drop detection arrangement comprising:

a light source for projecting a light beam;

a liquid drop ejector for ejecting a liquid drop through the light beam to scatter light off of the ejected drop;

a light collector configured to collect the scattered light off the ejected drop and configured to process the scattered light into an output signal, the output signal comprising a series of peaks, each peak indicative of a liquid drop passing through the light beam; and a controller configured to receive the output signal from the light collector, to calculate the velocity of the ejected drop, to calculate the area under each peak in the output signal, and to divide the calculated area by the calculated velocity of the ejected drop in order to determine the volume of the ejected drop.

2. The drop detection arrangement of claim 1, wherein the controller determines the volume of the ejected drop by integrating the intensity of scattering light off of the ejected drop over a time period that it takes for the ejected drop to travel though the light beam.

3. The drop detection arrangement of claim 1 further comprising a plurality of liquid drop ejectors, wherein the light collector is configured adjacent the plurality of liquid drop ejectors such that each liquid drop ejected from the plurality of liquid drop ejectors passes through the light beam to scatter light into the light collector.

4. The drop detection arrangement of claim 3, wherein the controller is configured to control the plurality of liquid drop ejectors and to correlate control of the plurality liquid drop ejectors with the output signal such that the volume of each of the ejected drops can be determined.

5. The drop detection arrangement of claim 1, wherein the controller calculates the velocity of the ejected drop by determining the amount of time that the ejected drop takes to go from the liquid drop ejector to the light beam and determining the distance between the liquid drop ejector and the light beam.

6. The drop detection arrangement of claim 1, wherein the light collector comprises one of a group comprising a light collector and a photodetector.

7. The drop detection arrangement of claim 1, wherein the light source comprises a collimated light source.

8. A drop detection arrangement comprising:

means for shaping a light beam;

means for controllably ejecting droplets such that they pass through the light beam to scatter light;

means for collecting the light scattered from each of the droplets and producing an output signal based on the all of the collected scattered light, the output signal comprising a series of peaks, each peak indicative of a droplet passing through the light beam; and means for calculating the velocity of the ejected droplets, for calculating the area under each peak in the output signal, and for dividing the calculated area by the calculated velocity of the ejected droplets in order to determine the volume of the ejected droplets.

9. The drop detection arrangement of claim 8, wherein the means for determining the volume comprises means for determining the volume of the ejected drop by integrating the intensity of scattering light off of the ejected droplet over a time period that it takes for the ejected droplet to travel though the light beam.

10. The drop detection arrangement of claim 8 wherein the means for controllably ejecting droplets comprises a plurality of liquid drop ejectors and the means for collecting the light comprises a light collector configured adjacent the plurality of liquid drop ejectors such that each liquid drop ejected from the plurality of liquid drop ejectors passes through the light beam to scatter light into the light collector.

11. The drop detection arrangement of claim 10, wherein the means for controllably ejecting droplets comprises a controller configured to control the plurality of liquid drop ejectors and to correlate control of the plurality liquid drop ejectors with the output signal such that the volume of each of the ejected drops can be determined.

12. A method of detecting drop volume in a drop ejection system, the method comprising:

projecting a light beam;

controllably ejecting droplets such that they pass through the light beam to scatter light;

collecting the light scattered from each of the droplets to produce an output signal based on the collected scattered light, the output signal comprising a series of peaks, each peak indicative of a droplet passing through the light beam;

calculating the velocity of the single ejected drop;

calculating the area under each peak in the output signal; and dividing the calculated area by the calculated velocity of the ejected droplets in order to determine the volume of the ejected droplets.

13. The method of claim 12, wherein determining the volume of the single ejected drop comprises integrated the intensity of scattering light off of the ejected drop over a time period that it takes for the ejected drop to travel though the light beam.

14. The method of claim 12, wherein calculating the velocity of the single ejected drop comprises determining the amount of time that the ejected drop takes to go from a liquid drop ejector to the light beam and determining the distance between liquid drop ejector and the light beam.

* * * * *